United States Patent [19]

Laird, Jr.

[11] 4,145,938

[45] Mar. 27, 1979

[54] STRAP WRENCH

[76] Inventor: Jonathan L. Laird, Jr., 50 E. First Ave., Parkesburg, Pa. 19365

[21] Appl. No.: 840,619

[22] Filed: Oct. 11, 1977

[51] Int. Cl.[2] ..... B25B 13/52

[52] U.S. Cl. ..... 81/64; 81/67 R

[58] Field of Search ..... 81/64, 66 R, 67 R, 68, 81/69, 70, 3.43

[56] References Cited

U.S. PATENT DOCUMENTS

| | | | |
|---|---|---|---|
| 1,077,591 | 11/1913 | Cameron | 81/64 |
| 1,294,515 | 2/1919 | Monahan | 81/64 |
| 1,422,302 | 7/1922 | Parker | 81/64 |
| 1,662,413 | 3/1928 | Bright | 81/67 R |
| 1,774,201 | 8/1930 | Jenkins | 81/64 |
| 2,081,383 | 5/1937 | Rector | 81/64 |

*Primary Examiner*—James L. Jones, Jr.

*Attorney, Agent, or Firm*—Dann, Dorfman, Herrell and Skillman

[57] ABSTRACT

A strap wrench has a handle having a strap element pivoted to the handle by a pair of links to permit passage of the free end of the strap portion between the links, whereby the strap may be wrapped in full circumscribing relation to a workpiece. The handle has a camming surface positioned to confront the exposed surface of the strap when it is wrapped around the workpiece and to engage the same and without moving parts to anchor the strap at that point when said handle is actuated to apply torque to the workpiece. The strap has a friction surface on the interior side confronting the workpiece and has a guide surface on the exposed side with lesser friction to permit the strap to slide over said camming surface prior to applying torquing action upon said handle to afford snug engagement of the strap with the workpiece. Preferably, the handle is formed of a one-piece rigid plastic composition having a density which permits the wrench to float near the surface of a body of liquid.

6 Claims, 4 Drawing Figures

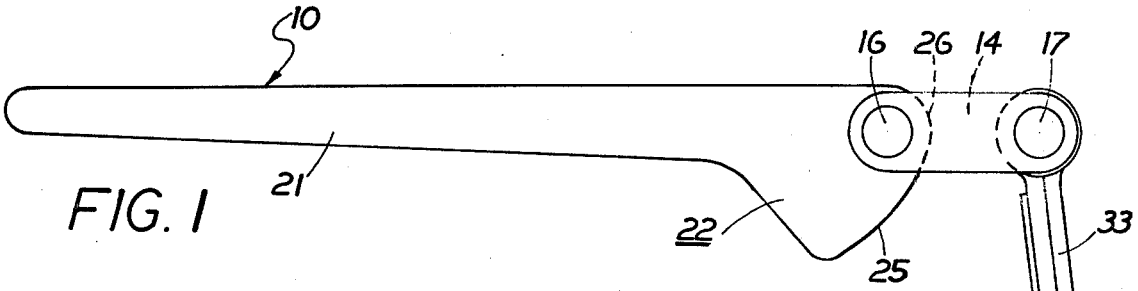
FIG. 1
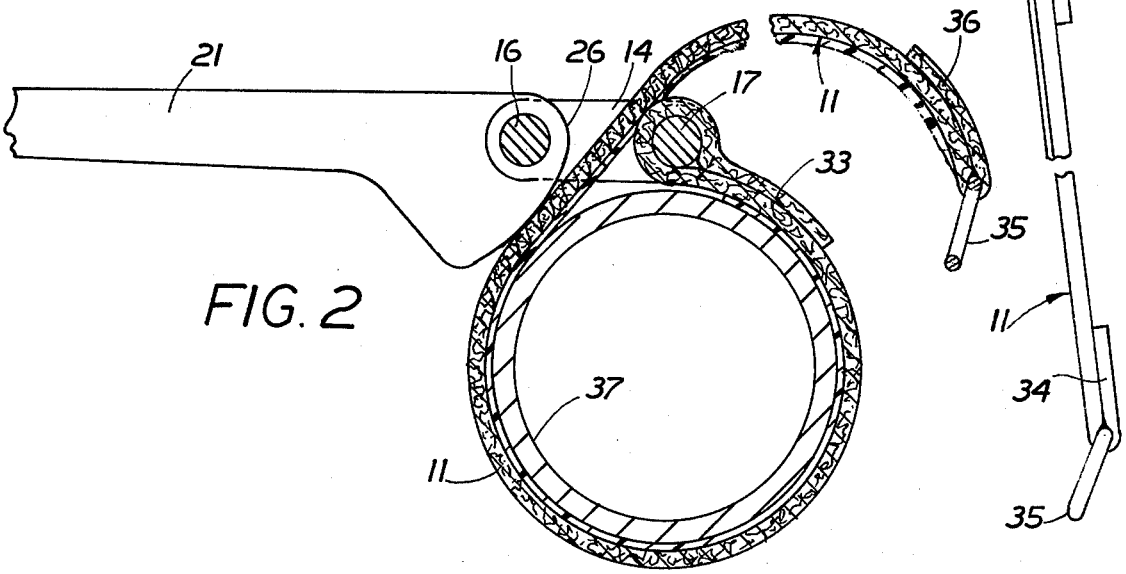
FIG. 2
FIG. 3
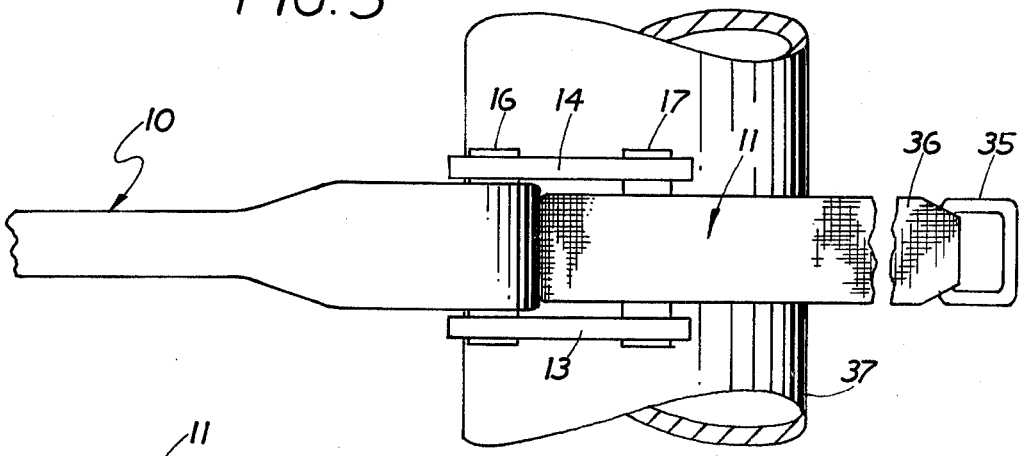
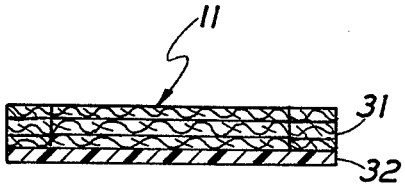
FIG. 4

STRAP WRENCH

The present invention relates to improvement in wrenches and more specifically to wrenches of the type shown in my prior U.S. Pat. No. 3,288,001, which affords a positive grip uniformly around an article for applying torque thereto, regardless of the article's external shape while, because of the specific structure of the wrench, a special friction effect insures positive engagement of the article to which the wrench is applied.

As is well known to those skilled in the art, the use of large pipe wrench or heavy monkey wrenches on pipes and their associated fittings oftentimes distorts, warps or crushes the pipe or fitting to where it may not be capable of further use. Further, many times it is desired to use a heavy wrench on a pipe or fitting in a difficult location, such as along the sides of walls, floors or in corners, and the size of the wrench necessary to obtain a firm grip upon the pipe or fitting makes it difficult to obtain a purchase on the fitting with a standard pipe wrench. Further, if it is desired to hold a pipe to prevent its turning within a fitting or the like, oftentimes the only place of obtaining a purchase on the pipe is on its threads, and a standard pipe wrench will ruin the threads.

My prior patented wrench applies uniform pressure on the greater part of the circumference of an article being gripped thereby avoiding warping, distorting or crushing of the pipe or fitting, and may be used in difficult places such as on pipes or fittings located adjacent walls or in other difficult locations.

A primary object of the present invention is to provide a novel wrench which is possessed of the desirable characteristics of patented wrench and yet which has additional advantages which are not present in my prior wrench.

Specifically, the present invention provides a wrench which may be made of lightweight material and yet which is fully effective in operation and use.

Another object of the present invention is to provide a wrench which may be used to apply uniform pressure on the greater part of the circumference of an article being gripped without danger of marring the surface of the article.

Still another object of the present invention is to provide a wrench having a work-engaging element in the form of a strap which may be wrapped around substantially the entire circumference of the article and may be manipulated with great facility, even in limited working space.

These and other objects of the invention are more fully set forth hereinafter with reference to the accompanying drawing, wherein:

FIG. 1 is a view in side elevation of a wrench embodying the present invention;

FIG. 2 is a fragmentary view with parts broken away to illustrate the wrench in operation;

FIG. 3 is a plan view of the wrench shown in FIG. 2; and

FIG. 4 is a transverse sectional view through the work-engaging element of the wrench shown in FIGS. 1 and 2.

Referring to the drawings, a strap wrench is illustrated therein which comprises a handle member 10 and a work-engaging strap element 11. The handle member is connected to the strap element 11 by a pair of connecting links 13 and 14. The links are pivoted to the handle by a pin 16 and are pivoted to the strap element by a pin 17. The spacing between the pins 16 and 17 is sufficiently large to permit free passage of the strap element between the handle and the pin 17, as shown in FIG. 2.

The handle element 10 comprises an elongated grip portion 21 and an enlarged head portion 22. The pin 16 passes through a bore in the enlarged head portion 22 which is disposed transverse to the longitudinal center line of the elongated gripping portion 21. The head portion has a width substantially larger than the grip portion so as to provide an elongated bearing surface within the bore provided for the pin 16. At the end of the head portion remote from the grip portion, the end surface of the head portion is provided with a convex arcuate camming surface 25 which faces the strap element 11. In the present instance, the camming surface 25, in the area below the bore for the pin 16, has a uniform radius of curvature approximately one-fifth of the axial length of the gripping portion 21 and the surface merges into the upper surface of the head portion 22 with a guide surface 26 having a circular curvature centered about the bore 16.

The handle element 10 is preferably formed from a high-impact polypropylene copolymer which is light in weight, yet has sufficient rigidity to withstand the normal torquing forces which may be applied to the wrench. The plastic material is readily machined to provide the desired cam surface and bore in the head portion 22 of the handle and may be shaped in the grip portion 21 to provide a comfortable gripping surface. The density of the material may be selected to provide sufficient buoyancy to allow the wrench to float near the surface of a liquid material and, thus, the wrench is particularly suitable for use on boats and in other facilities where work must be performed over a body of liquid. The plastic material is also highly resistant to corrosion or damage by material which attacks standard fittings or joints. In addition, the use of a plastic material avoids risk of sparking and permits the wrench to be used with safety in highly combustible atmospheres.

The strap 11 is composed of a material which is high in tensile strength. As shown in FIG. 2, the strap material is looped around the pin 17 and is secured back on itself at 33 to provide a journal around the pin 17 permitting free pivotal movement of the strap on the pin. At the other end, the strap, in the present instance, is bent back as indicated at 34 to receive a ring element 35 which may serve as a pilot for manipulating the strap. The strap material is of limited flexibility so that it has a tendency to straighten out when freely suspended and has sufficient resilience to return to the straightened position after being wrapped around the workpiece. The strap is sufficiently flexible to conform to the surface of the workpiece, and it is of significant importance to provide a friction surface on the side of the strap which confronts the workpiece and a less-frictional guide surface on the exposed side of the strap. As shown in FIG. 2, the frictional surface bears against the workpiece, whereas the less-frictional guide surface is free to slide on the cam surface 25 and the guide surface 26 as the strap is threaded between the handle head 22 and the pin 17.

A preferred construction of the strap 11 is shown in FIG. 4 wherein the body of the strap comprises a multiply webbing 31 having on its undersurface a coating 32 of elastomeric material which bonds to the webbing 31. A triple-ply nylon webbing having neoprene coating bonded to one side thereof has been successfully used with good results. The selection of the material in the webbing and the coating respectively should be determined by the use to which the wrench is applied and the material to which the strap is exposed in such use.

FIG. 2 illustrates the use of the strap wrench of the present invention for applying counterclockwise torque to a circular pipe 37. In FIGS. 2 and 3, the pipe 37 has a diameter approximately equal to the radius of curvature of the camming surface 25, but the wrench may be effectively applied to workpieces having substantially larger diameters as well as to workpieces having substantially smaller diameters. A particular desirable feature of the invention is the ability of the single wrench to effectively torque a wide range of workpieces, not only workpieces of circular outlines, but also workpieces having hexagonal, octagonal or other regular or irregular outlines, the flexibility of the strap being such as to conform to the outline of the workpiece.

As illustrated in FIG. 2, the strap 11 is wrapped clockwise around the workpiece 37 and the free end of the strap is threaded between the head portion 22 of the handle and the pin 17. To this end, the pilot ring 35 may be used to draw the free end of the strap along both the camming surface 25 and the guide surface 26 through the opening between the head portion 22 and the pin 17. The pilot ring 35 may be used to tighten the strap snugly around the workpiece, the wrench being held sufficiently far from the workpiece to permit easy sliding of the strap around it. In FIG. 2, the free end of the strap is shown overlying the pin 17, but in cramped quarters, the rounded guide surface 26 permits the strap to be pulled along the gripping portion 21 of the handle 10 to snugly engage the strap against the workpiece. When the strap is snugly engaged, the handle is pressed downwardly to provide a counterclockwise torque. The downward movement of the handle first engages the camming surface 25 against the outer surface of the strap and tends to compress the strap 11 between the camming surface 25 and the outer surface of the workpiece 37. The frictional surface provided by the coating 32 frictionally engages the strap 11 against the workpiece 37 and anchors the strap against circumferential movement. Further downward pressure on the handle 10 causes the camming surface 25 to bear further against the strap and provide a fulcrum which tends to displace the pin 16 leftward (as seen in FIG. 2). Leftward pressure on the pin 16 by the bore in the head portion 22 is transmitted through the links 13 and 14 to the pin 17 which thereby exerts a tangential force on the strap 11 causing further tightening of the strap around the workpiece. The tightening of the strap around the workpiece increases the frictional force anchoring the strap to the workpiece and provides further gripping action about substantially the entire circumferential extent of the workpiece between the point where the camming surface 25 engages the strap and the pin 17. The gripping force is thereby distributed uniformly about substantially the entire circumference of the workpiece avoiding high stress concentrations. With the strap thereby firmly engaged and applying gripping pressure about the entire circumference of the workpiece, further downward pressure on the handle exerts a tangential force on the strap at the pin 17 which, in turn, creates a counterclockwise torque tending to rotate the workpiece counterclockwise.

It should be noted that in the operation of the strap wrench of the present invention, the strap is snugly engaged with the workpiece and is anchored against the workpiece by the cam surface. Thus, the position of wrench relative to the workpiece may be adjusted to any point on the circumference of the workpiece so that the wrench may be manipulated to give the greatest throw desired. This is of particular significance in connection with hexagonal and irregular workpieces since it avoids the necessity to displace the wrench circumferentially on the workpiece until it finds a proper seat. In accordance with the present invention, the seating of the wrench on the workpiece is accomplished by the engagement of the cam surface 25 against the strap to bear against any point on the circumference of the workpiece and thereafter the movement of the handle first snugly engages the strap on the workpiece and then torques it, thereby avoiding the lost motion which is normally occasioned in the use of standard wrenches.

The illustrated embodiment of the invention is particularly applicable to wrenches for use in a wide variety of applications. For special applications, it may be desired to provide a strap wrench in accordance with the present invention having a width substantially greater than that of the illustrated embodiment, particularly where a large torquing force is required. By the same token, where the configuration of the workpiece requires it, the width of the strap may be reduced substantially to permit application of the torque to work elements having very limited axial length. The wrench has proved to be particularly suitable for use in confined spaces inasmuch as the simplicity of operation enables the wrench to be manipulated with one hand when necessary and once the strap element is snugly engaged with the workpiece, the tightening action is effected by simple manipulation of the gripping portion of the handle using the cam surface 25 as a fulcrum.

While the particular embodiment of the present invention has been illustrated and limited modifications have been described, it is apparent that other changes and modifications may be made therein and thereto within the scope of the following claims.

I claim:

1. A strap wrench comprising a handle having an elongated grip portion and an enlarged head portion, link means pivoted to said handle at its forward end, and a strap element pivoted at one end to said link means in spaced relation to said head portion to permit passage of the opposite free end of the strap element between the forward end of said head portion and the said one end of said strap element, whereby said strap element may extend forwardly from said pivotal connection over and around the workpiece in circumscribing relation to a workpiece and pass upwardly between said handle and said pivotal connection, a camming surface on the underside of said handle extending rearwardly from the pivotal connection of said links to said handle and positioned to confront the exposed surface of said strap element when it is wrapped around the workpiece and to engage the same when said handle is actuated downwardly to apply torque to the workpiece, said camming surface being convex and having a uniform radius of curvature approximately one-fifth of the axial length of the gripping portion of the handle to compress said strap element between said convex camming surface and the exterior surface of the workpiece, said strap element having a friction surface on the interior side confronting the workpiece and having a guide surface on the exposed side confronting said camming surface to permit said strap element to slide over the underside of said camming surface prior to applying torquing action upon said handle to afford snug engagement of the strap element with the workpiece, said curvature of said camming surface limiting flexure of said strap where it is compressed between said camming surface and the workpiece.

2. A wrench according to claim 1 wherein said handle is formed of a one-piece rigid plastic composition having a density which permits said wrench to float near the surface of a body of liquid.

3. A wrench according to claim 1 wherein said strap element comprises a multi-ply webbing material strong in tension having on the work-engaging surface thereof a coating of elastomeric material bonded to said webbing.

4. A wrench according to claim 3 wherein said coated webbing has a stiff flexibility tending to straighten the webbing and being resilient so as to return to straight extension when released from circumferential wrapping about the workpiece, the flexibility of the strap element being sufficient to permit said strap element to conform to the circumferential configuration of the workpiece about substantially the entire circumference thereof.

5. A wrench according to claim 1, including a pilot ring at said opposite free end of the strap element to facilitate threading of said strap element through the space between said head and said pivot.

6. A wrench according to claim 1 wherein said handle has a cylindrical bore disposed at its forward end transverse to the longitudinal center line of said elongated grip portion, and said link means comprises a pair of link plates disposed on opposite sides of said strap element and a pin passing through said cylindrical bore in said head portion to pivotally connect said strap element to said head portion.

* * * * *